United States Patent [19]

Köbler et al.

[11] 4,404,907

[45] Sep. 20, 1983

[54] WEB THREADING APPARATUS FOR ROTARY PRINTING MACHINES

[75] Inventors: Ingo Köbler, Gessertshausen; Johann Winterholler, Friedberg, both of Fed. Rep. of Germany

[73] Assignee: M.A.N.-Roland Druckmaschinen Aktiengesellschaft, Offenbach am Main, Fed. Rep. of Germany

[21] Appl. No.: 260,687

[22] Filed: May 5, 1981

[30] Foreign Application Priority Data

May 16, 1980 [DE] Fed. Rep. of Germany ..... 3018740

[51] Int. Cl.[3] ..... B41F 13/02

[52] U.S. Cl. ..... 101/228; 101/225; 474/131

[58] Field of Search ..... 101/228, 225; 226/91, 226/92; 474/121, 131, 140, 144, 146, 111; 198/841

[56] References Cited

U.S. PATENT DOCUMENTS 1,288,550 12/1918 Forsyth ..... 474/140

3,995,553 12/1976 Winterholler et al. ..... 101/228

*Primary Examiner*—Edgar S. Burr

*Assistant Examiner*—Charles A. Pearson

*Attorney, Agent, or Firm*—Frishauf, Holtz, Goodman & Woodward

[57] ABSTRACT

To prevent jamming of a threading roller chain being pushed against the teeth of a sprocket wheel which, in advance of being driven, is still stationary, a portion of the guide rail guiding the roller chain (11) and opposite the sprocket wheel (24) is formed to be resiliently deflectable, for example by including a rocker element (36) or a resilient track portion (51, 52), the rocker element or the resilient track portion being maintained by a spring (46, 55) in normal, undeflected position, but permitting deflection, the spring means returning the resiliently deflectable portion to aligned, undeflected position upon proper feeding and threading of the roller chain.

11 Claims, 6 Drawing Figures

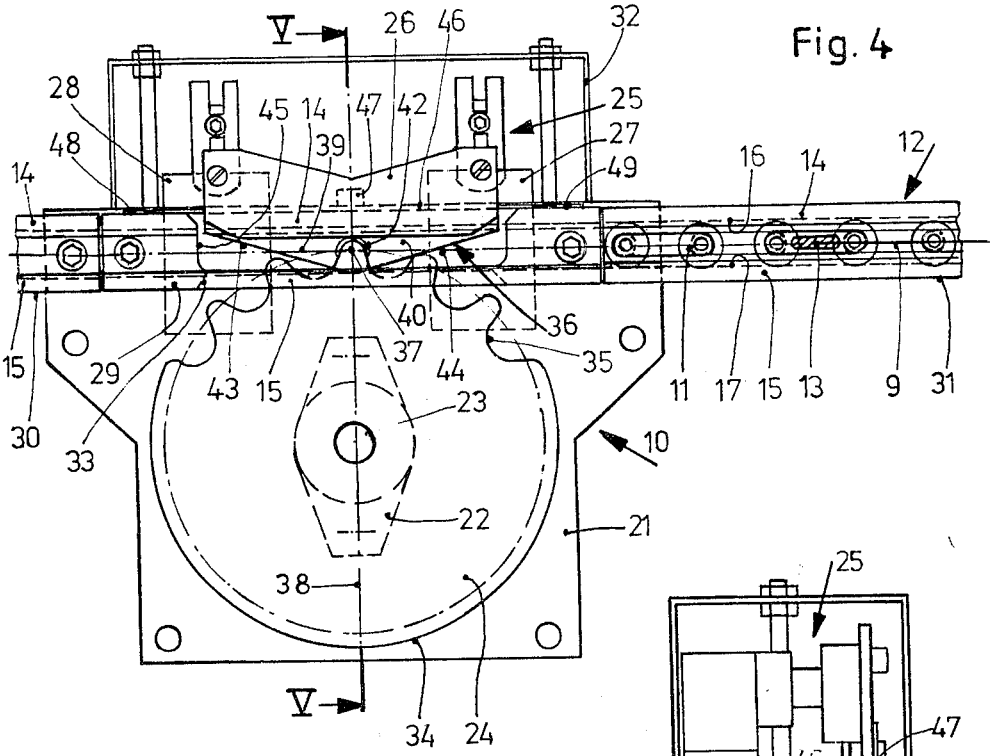
Fig. 4
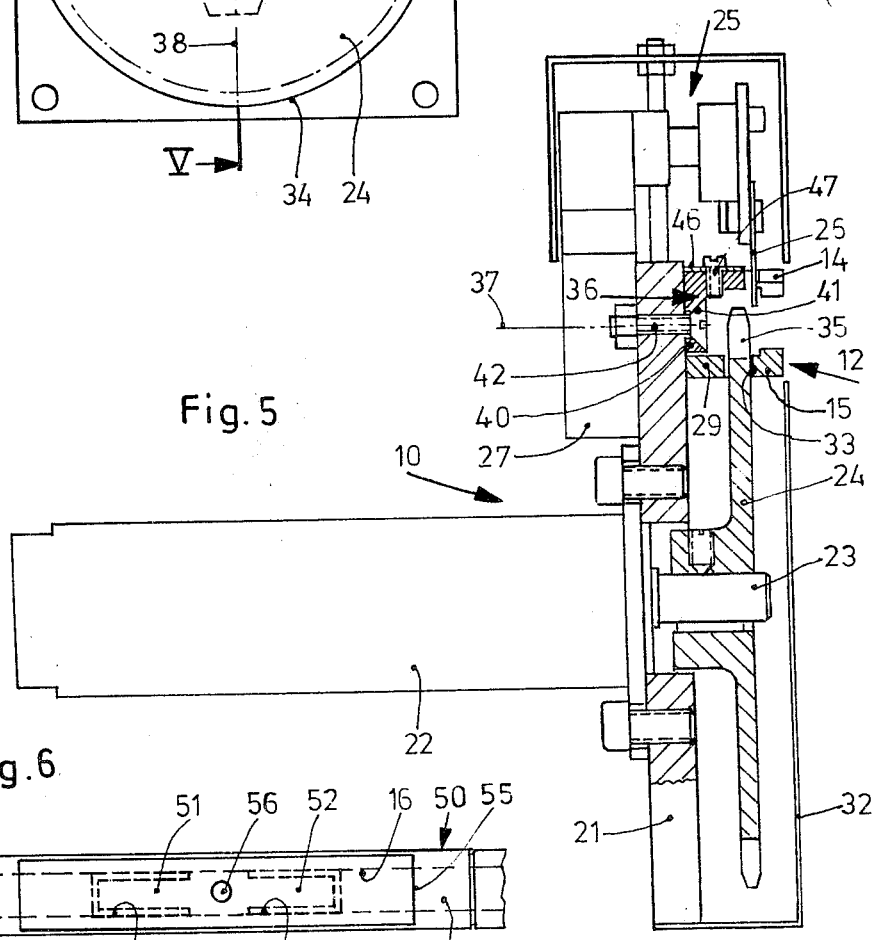
Fig. 5
Fig. 6
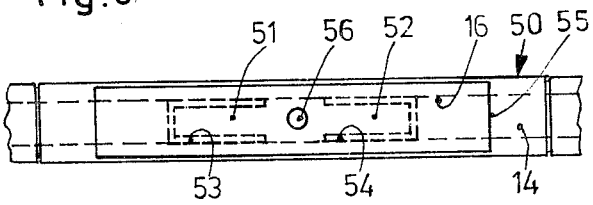

WEB THREADING APPARATUS FOR ROTARY PRINTING MACHINES

The present invention relates to apparatus to thread webs, typically paper webs, into rotary printing machines, for example offset rotary printing machines, and more particularly to apparatus which is specifically associated with moving a roller chain carrying a web clamp through the machine.

BACKGROUND

Various types of web threading apparatus for association with rotary printing machines have been proposed. One such apparatus is shown in German Patent No. 24 02 768 to which U.S. Pat. No. 3,995,553, assigned to the assignee of this application corresponds. This arrangement discloses parallel guide tracks for a roller chain transporting the web through the machine. The roller chain is not as long as the length of the machine, but is sectioned, with drive wheels or sprockets being located at suitable distances, preferable equal, throughout the machine, to be selectively energized as the roller chain carrying a web therewith approaches a sprocket, the sprocket then engaging the roller chain to transport it in the threading path to the next sprocket. Although the probability is small, the situation may arise that the sprocket teeth of a stationary drive wheel are in the worst possible position with respect to the approaching roller chain, resulting in jamming of the first roller, which is pushed towards the sprocket wheel with a predetermined drive speed. The chain can jam, i.e. the flank of the moving chain may wedge with respect to the opposite guide rail portion. Malfunction of the threading apparatus results, and the consequent interruption is difficult to clear.

The Invention

It is an object to improve threading apparatus of webs into rotary printing machines in which the feed of a transport roller chain is insured even though the respective sprocket drive wheels, or any one of them, is in a position unsuitable for immediate engagement with the roller chain.

Briefly, the guide rail is so constructed that it has a portion which, opposite the major diameter of a sprocket wheel, is yielding so that, as the leading portion of the chain is fed toward the sprocket wheel, the guide rail portion can deflect from its normal guidance position and, after engagement of the sprocket with the leading end of the roller chain, can return, resiliently, to its normal position. Various arrangements are possible, for example by forming a portion of the guide rail in the shape of a rocker, which is resiliently maintained in a normal position forming a continuation of the guide track, but can lift off the normal position as well as rock with respect to a line perpendicular to the lifting point and the center of the sprocket wheel; alternatively, a portion of the guide rail can be made resiliently deflectable, held in position by a leaf spring.

DRAWINGS

FIG. 4 is a side view, partly cut away, and to a greatly enlarged scale, of a drive unit for the transport roller chain;

FIG. 5 is a schematic cross section taken along line V—V of FIG. 4; and

FIG. 6 is a top view of a second embodiment of a resiliently yielding portion of the guide track.

Figure 1:
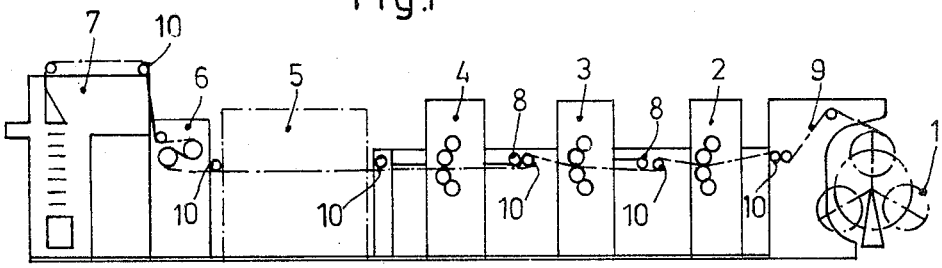
FIG. 1 is a highly schematic side view of a rotary printing machine having three printing systems.

A rotary printing machine, shown only in highly schematic form, has a paper web supply spider 1 to supply a printing paper web 9 through a plurality of printing systems 2, 3, 4, to be then guided through a dryer 5, a cooling tower 6 and a folding apparatus 7. The paper web 9 is prevented from vibrating or fluttering in its path through the machine by rollers 8 which also insure feed of the paper web to the respective printing stations in a desired alignment and requiring only small engagement angles with the respective printing cylinders of the printing systems 2, 3, 4.

Figure 2:
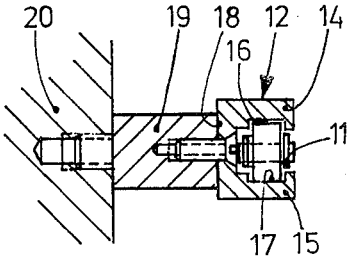
FIG. 2 is a schematic cross-sectional view through a threading guide track, and the holding portions therefor.
Figure 3:
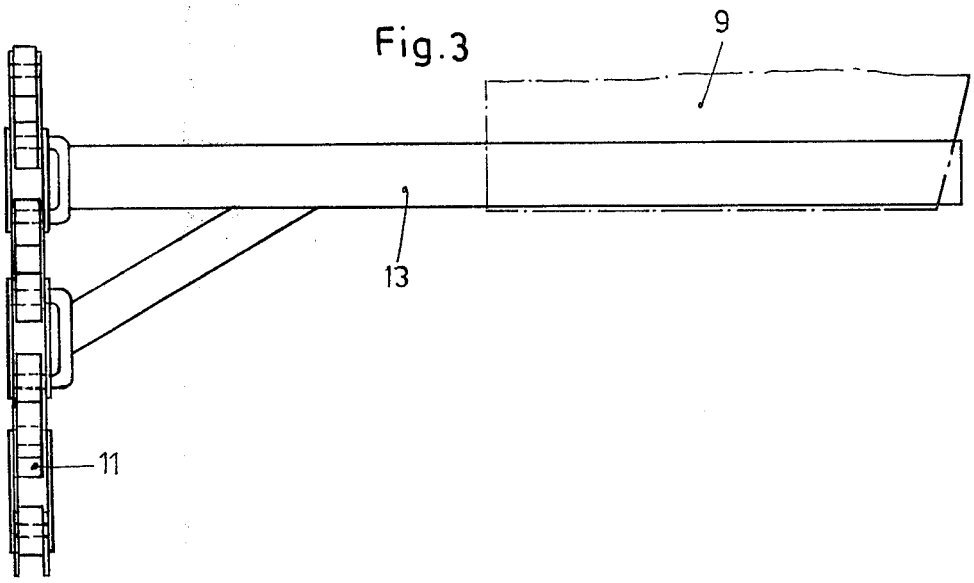
FIG. 3 is a highly schematic top view of a web threading chain and carrier.

The paper web 9 is threaded in accordance with a predetermined threading path by a plurality of drive units 10, shown in greater detail in FIGS. 4 and 5, and which are preferably all identical. The drive units 10 can engage a flexible transport roller chain 11 (see FIGS. 3 and 4) along a chain guide track 12—FIGS. 2, 4 and 5. The roller chain 11 is pushed in its guide track. The paper web 9 is gripped by a gripper or holder 13 which is laterally secured to the roller chain 11—see FIG. 3. The chain guide 12, as best seen in FIG. 2, is made of a plastic, shaped element, with essentially U-shaped or C-shaped cross section, to form two parallel guide rails 14, 15 with guide grooves 16, 17 therein to guide the roller chain 11. A back wall 18 closes off the guide rail. The guide rail 12 is constructed of several serially arranged single elements which are secured by spacer blocks 19 to wall portions 20 of the printing machine in the path of the paper web, as it is to be threaded through the machine.

The drive units 10 for the roller chain 11—see FIGS. 4 and 5—have a support wall 21 which is secured along the transport path, similar to the rail elements 12 to a side wall 20 of the printing machine. The drive units 10 each have a motor 22, preferably operating similarly to an air turbine, for example with compressed air, and each have a drive shaft 23 on which a sprocket drive wheel 24 is secured. The drive units 10 further have a sensor 25 which includes a sensing rod plate 26 (see FIG. 5) and switching elements 27, 28 to energize the motor 2 of the respective drive units when presence of a roller chain element is sensed and to turn OFF the respective drive unit when it is no longer needed. The drive unit further includes component parts 29, 30, 31 of the guide track 12 and a cover cap 32. The component part 29, within the guide track portion 15, is formed with an opening 33 to permit the sprocket wheel 24 to engage into the guide track. The sprocket wheel 24 has an outer diameter circle 34 and teeth 35 which can extend in the space between the legs 14, 15 of the guide track 12 in the region of the part 29, in order to insure reliable acceptance of the first roller link of the transport roller chain 11 and subsequent engagement and transport of further links of the roller chain.

In accordance with the present invention, and in order to prevent jamming of a link against a sprocket tooth and the confining legs 14, 15 of the guide track, or any lateral skew of the roller chain, a portion of the guide track leg or element 14 is constructed or formed to be resilient and capable of deflecting in the direction transverse to the threading direction from a normal position, and being returned into the normal position. The portion which can deflect is immediately adjacent the outer circle 34 of the drive sprocket 24. The normal position, as herein referred to, is an aligned position of the resiliently constructed guide rail portion with reference to adjacently located stiff portions of the guide track.

FIGS. 4 and 5 illustrate one embodiment of the invention, in which a portion of the guide track 14 is located on a pivoting, or rocker element 36 within the region of the part 29 of the chain guide track 12. The rocker 36 is centrally pivotably secured and held by spring force in the normal position, the spring returning the rocker 36 after deflection into the normal position. The pivot axis 37—FIG. 5—of the rocker 36 is positioned at an intersection of a central vertical line 38 (FIG. 4) with respect to the center line 36 between the legs 14, 15 (FIG. 2) of the guide track. The rocker 36 has a guide wall 40 which carries the resilient portion of the track 14, a bore 41 to permit a bearing bolt 42 to pass therethrough, and to accept a recessed screw head. Further, the rocker 36 has lower edges 43, 44, extending at an obtuse angle 43, 44 with respect to each other, and which, in combination with the associated adjacent guide track portion 15, define the rocking angle of the rocker 36 with respect to the lateral deflecting sides thereof.

The rocker 36 is secured in the region of the sprocket wheel 24 in a cut-out 45 within the fixed guide track leg 15 in the region of the part 29 of the chain guide track. The rocker 36, itself, can pivot about the bearing screw 42 and is secured thereby at the same support wall 21 in which also the further parts of the drive unit 10 are secured, as above referred to. A leaf spring 46 is located on the upper side of the rocker 36. The leaf spring 46 extends at both sides over the rocker 36, being secured thereto by screw 47. The upper side of the rocker 36 is level and is in alignment with the upper side of the parts 30, 31 of the track 12. Parts 30, 31 are unmovably mounted adjacent rocker 36. The leaf spring engages with its projecting end portions 48, 49 over the parts 30, 31 of the chain track. The leaf spring 46 and the projecting portions 48, 49 thereof hold the rocker 36 in normal position.

Operation: If the first roller of a transport roller chain 11 happens to meet an unfortunately positioned tooth 35 of the sprocket wheel 24, the rocker 36, in combination with the leaf spring 46, permits deflection and passage of the first roller of the transport roller chain over the first and poorly positioned tooth 35 of the sprocket wheel 24. The rocker will deflect and, after the roller has passed over the head of the wheel, it will press the roller of the link chain into the next subsequent gap between the teeth by the spring 46 which returns the rocker into normal position. The transport chain 11, being fed to a drive station 10 by a preceding station with a predetermined speed, thus can deflect without interference with the feed path by deflecting the rocker 36 counter the force of the leaf spring 46, which leaf spring will then place the roller into proper position on the sprocket and return the rocker 36 into normal position. Since, upon introduction of the first roller of the transport roller chain into the drive unit 10, the sensing lever 26 will also be engaged, the drive motor 22, previously stopped, will now be energized, and the previously energized drive motor disconnected, so that the further transport of the transport roller chain 11 will continue without interruption and provide for precise guidance without danger of pinching or jamming of the first roller of the roller chain regardless of the particular instantaneous position of the sprocket wheel 24.

FIG. 6 illustrates another arrangement in which a portion 50 of the chain guide track 12 is placed in the same position as the portion 29 in FIGS. 4 and 5 of any one drive unit. The portion 50 has two resilient track portions 51, 52, located symmetrically to a center line 38, as in FIG. 4. The resilient track portions 51, 52 are obtained by milling a U-shaped groove 53, 54. The guide track portions 51, 52 can be resiliently deflected due to the inherent elasticity of the material of the portion 50 which, for example, is made of a suitable plastic, so that deflection is possible from the normal position. A leaf spring 55 returns deflected portions 51, 52 into normal position after deflection. The leaf spring 55 is secured to the upper side of the guide track leg 14 between the resilient elements 51, 52 of the guide track, for example by a rivet 56 or the like. The distance of the relative parallel legs of the respective grooves 53, 54 corresponds preferably to the width of the guide groove 16 in the track 14, so that lateral guidance of the transport roller chain is insured also within the region of the resilient guide track parts or portions 51, 52.

OPERATION

Operating of threading and feeding is similar to that of the rocker 36 described above in connection with FIGS. 4 and 5.

Various changes and modifications may be made, and features described in connection with any one of the embodiments may be used with any of the others, within the scope of the inventive concept.

We claim:

1. In combination with a rotary printing machine a web threading apparatus for use in the rotary printing machine comprising a track (12) having guide rails, including an inner guide rail (15), and an outer guide rail (14) parallel to the inner guide rail and spaced therefrom;

a roller chain (11) having a leading end, positioned in said track, sliding on at least one of said guide rails, guided by the guide rails, and having attachment means (13) for attachment thereto of a web (9) of material to be threaded into the printing machine, and a sprocket wheel (24) adapted to receive the leading end portion of the chain and to then engage in the links between the rollers of the roller chain, said sprocket wheel extending through one of the guide rails into the space between both of the guide rails (14, 15) of said track in a section thereof, and means to permit reliable interengagement of the sprocket wheel projecting in the space between the guide rails with the leading end portion of the chain, said means including a movable rail element (36) located in said section, and spring means (46) retaining said movable rail element in a normal position forming a continuation of the outer guide rail of the track and capable of resilient deflection in a direction transverse to the direction of movement of the chain when the chain is being fed in the track toward the sprocket wheel for engagement with the leading end portion of the chain, and being returned from deflected position to permit reliable interengagement of the sprocket wheel with the roller chain regardless of relative position of the chain and sprocket wheel upon initial contact therebetween.

2. Apparatus according to claim 1, wherein said movable rail element comprises a rocker (36), the spring means (46) retaining said rocker in said normal position but permitting resilient rocker deflection therefrom by a deflecting force exerted by the roller chain, and returned to normal position upon cessation of said deflecting force.

3. Apparatus according to claim 2, wherein the rocker has a pivot axis (37), and said axis is positioned on a theoretical line (38) passing through the center of rotation of the sprocket wheel (24) and extending at a right angle with respect to a center line (39) between the inner and the outer guide rails (15, 14) of the track.

4. Apparatus according to claim 2, wherein the rocker (36) includes a guide wall (40) which forms the resiliently deflectable portion of the outer guide rail (14) of the track;

a bore (41) and means forming a pivot shaft (42) positioned within said bore, said rocker being formed with edge portions (43, 44) which, with respect to each other, are located at an obtuse angle and limit the rocking deflection of said rocker.

5. Apparatus according to claim 4, wherein said track is U-shaped and is formed with a recess (45), said rocker (36) being located within said recess, said pivot shaft (42) being positioned in the region of said recess;

and a common support plate (21) for said sprocket wheel, said rocker, and portions of said track adjacent said resilient portion.

6. Apparatus according to claim 2, wherein the spring means (46) comprises a leaf spring having end portions (48, 49) extending beyond the end limits of said rocker.

7. Apparatus according to claim 6, wherein said rocker (36) is formed with an engagement surface at an upper portion thereof, against which said leaf spring (46) is positioned;

and is further formed with a surface in alignment with the adjacent portions of the outer guide rail (14) of said track (12).

8. In combination with a rotary printing machine, a web threading apparatus comprising a track (12) having guide rails including an inner guide rail (15), and an outer guide rail (14) parallel to the inner guide rail, and spaced therefrom;

a roller chain (11) having a leading end, positioned in said track, sliding on at least one of said guide rails, guided by the guide rails and having attachment means (13) for attachment thereto of a web (9) of material to be threaded into the printing machine, a sprocket wheel (24) adapted to receive the leading end portion of the chain and to then engage in the links between the rollers of the roller chain, said sprocket wheel having a portion extending through one of the guide rails into the space between both of the guide rails (14, 15) of said track in a section thereof;

and means to permit reliable interengagement of the portion of the sprocket wheel projecting into the space between the guide rails with the leading end portion of the chain, said means including a track portion made of resilient, yielding material;

parts of the outer guide rail being formed as resilient rail elements in the section of said track into which the sprocket wheel (24) extends, said parts being capable of resilient deflection in a direction transverse to the direction in which the chain is being fed, said parts being held in normal position in alignment with adjacent portions of said track and returned into normal, aligned position after deflection upon engagement with said roller chain and after having been subjected to a deflecting force, said rail elements being positioned symmetrically with respect to a theoretical line or axis (38) passing through the center of rotation of said sprocket wheel (24) and being positioned perpendicularly to a center line between the inner and outer guide rail of said track.

9. Apparatus according to claim 8, further including spring means (55) retaining said rail elements in normal, aligned position.

10. Apparatus according to claim 9, wherein said spring means comprises a leaf spring (55) being positioned over said rail elements.

11. Apparatus according to claim 8, wherein said rail elements are formed by grooves cut into one of said guide rails (14,15) of the track which is positioned remote from the sprocket wheel (24) to permit resilient deflection thereof with respect to the remainder of the track;

and spring means (55) retaining said elements in normal, non-deflected position after having been subjected to a deflecting force by the roller chain.

* * * * *